US007156761B2

(12) United States Patent
Mesa

(10) Patent No.: US 7,156,761 B2
(45) Date of Patent: Jan. 2, 2007

(54) AIR ACTUATED SOFT TOSS BATTING PRACTICE APPARATUS

(76) Inventor: Jose Mesa, 407 Oyster Rd., N. Palm Beach, FL (US) 33408

( * ) Notice: Subject to any disclaimer, the term of this patent is extended or adjusted under 35 U.S.C. 154(b) by 9 days.

(21) Appl. No.: 10/819,836

(22) Filed: Apr. 6, 2004

(65) Prior Publication Data

US 2005/0221920 A1 Oct. 6, 2005

(51) Int. Cl.
*A63B 69/00* (2006.01)

(52) U.S. Cl. ..... 473/451; 473/431; 473/422

(58) Field of Classification Search ..... 473/415, 473/432, 436, 431, 421, 454–456; 124/64, 124/6, 7, 56
See application file for complete search history.

(56) References Cited

U.S. PATENT DOCUMENTS 1,043,308 A * 11/1912 Everson ..... 473/432
2,082,818 A * 6/1937 Atwell ..... 473/436
2,089,526 A * 8/1937 Andreas ..... 177/14
3,001,795 A * 9/1961 Johnson, Jr. ..... 473/197
4,275,883 A * 6/1981 Grimaldi et al. ..... 473/432
4,573,679 A 3/1986 Janszen
4,830,371 A 5/1989 Lay
4,861,027 A * 8/1989 Thaxton ..... 473/431
4,974,843 A * 12/1990 Henningsson ..... 473/431
5,133,548 A * 7/1992 Bedord et al. ..... 473/436
5,141,226 A * 8/1992 Cavanagh ..... 473/460
5,160,131 A * 11/1992 Leon ..... 473/451
5,257,615 A * 11/1993 Jones ..... 124/56
5,271,616 A * 12/1993 Grimaldi ..... 473/432
5,485,994 A * 1/1996 Underwood et al. ..... 473/451
5,496,025 A * 3/1996 Phillips et al. ..... 124/56
5,507,271 A 4/1996 Actor
5,588,645 A * 12/1996 Schwan et al. ..... 473/456
5,730,666 A * 3/1998 Hudson ..... 473/421
5,733,209 A * 3/1998 McIntyre, IV ..... 473/436
5,746,670 A 5/1998 Brady
5,771,621 A 6/1998 Rogers
5,823,894 A 10/1998 Actor
5,996,565 A 12/1999 Whitmer
6,155,936 A * 12/2000 Dorr ..... 473/456
6,167,878 B1 * 1/2001 Nickerson et al. ..... 124/64
6,505,617 B1 1/2003 Neuman
6,508,243 B1 1/2003 Long
6,523,533 B1 2/2003 Armstrong et al.
6,539,931 B1 4/2003 Trajkovic et al.
6,546,924 B1 4/2003 Battersby et al.
6,620,064 B1 9/2003 Nickerson
6,637,422 B1 10/2003 Wojtkiewicz et al.
6,647,975 B1 11/2003 Whitfield
6,666,776 B1 12/2003 Yamaguchi
6,666,781 B1 12/2003 Illis
6,672,979 B1 1/2004 Brenneisen
6,684,872 B1 2/2004 Kao et al.
6,695,725 B1 2/2004 Burns, Jr.
6,705,305 B1 3/2004 Suba et al.
6,709,351 B1 3/2004 Hori

* cited by examiner

*Primary Examiner*—Mitra Aryanpour
(74) *Attorney, Agent, or Firm*—McHale & Slavin PA

(57) ABSTRACT

The instant invention relates to a training device for batting practice. More specifically, the instant invention provides a catch net in combination with an air powered ball return assembly. The ball return assembly delivers a lightweight polymeric ball to a batter in the form of a soft-toss. A hit ball is caught by the net and recycled to the batter. The ball may be hit and recycled back to the batter for a player specified length of time.

19 Claims, 6 Drawing Sheets

AIR ACTUATED SOFT TOSS BATTING PRACTICE APPARATUS

FIELD OF THE INVENTION

This invention relates to an apparatus for soft tossing a lightweight ball to a batter for hitting practice, and more particularly to an air-driven ball delivery device having a catch net for receiving a lightweight ball and recycling it back to the delivery device.

BACKGROUND OF THE INVENTION

There are many ball-throwing machines on the market. Most require at least two people to operate, and most are not suitable for young children to use by themselves because of possible injury from the propelled ball. These machines deliver a normal sized and weight ball (i.e., a hard ball weighing 9 oz.) to the batter at speeds of 60 to 70 m.p.h. At these delivery speeds and weights, the area around where a baseball is thrown is dangerous and not suited for young children. Also, most baseball throwing machines require a large outdoor area for use that makes them impractical during inclement weather.

Some examples of this type of device are taught in U.S. Pat. Nos. 6,505,617, 6,508,243, 6,523,533, 6,546,924, 6,647,975 and 6,705,305.

There are also numerous stationary and tethered ball-hitting devices on the market. Some examples of these devices are taught in U.S. Pat. Nos. 4,830,371, 6,666,776, 6,666,781 and 6,672,979. While these devices are suitable for young children they do not develop "eye on the ball" coordination as well as an untethered ball. In addition the stationary untethered hitting devices require balls to be retrieved and loaded manually one at a time onto the device before each hit.

It is also known in the art to utilize highly pressurized air to propel a ball toward a batter. U.S. Pat. Nos. 5,507,271 and 5,823,894 teach apparatus for propelling balls smaller than a baseball, such as a golf whiffle ball, at timed intervals from a storage bin. The bin contains a plate with a single hole that rotates at timed intervals and permits one ball to be delivered to a continuous air source to propel the ball to a batter. This small ball is then hit with a bat that is smaller and lighter in weight than an ordinary baseball bat.

U.S. Pat. No. 5,771,621 teaches a portable ball pitching machine which uses a combusting gas to drive a piston which compresses air behind a ball and propels the ball through a barrel. A combustible mixture of air and propane are introduced into a combustion chamber, and a ball is loaded against an air exit of a barrel housing. The gas is ignited in the combustion chamber driving a piston through a compression chamber and generating compressed air. The compressed air is directed through the barrel housing to the air exit and the ball is propelled from the barrel.

U.S. Pat. No. 6,539,931 teaches a ball throwing machine which includes a camera connected to a computer vision unit and a microphone connected to a speech-processing unit. The computer vision unit processes images from the camera to determine a user's position, and to detect user gestures from a predetermined repertoire of gestures. The speech-processing unit recognizes user vocal commands from a predetermined repertoire of commands. A computer receives information from a control panel, from the computer vision unit, from the speech-processing unit, and from a file describing the ballistic properties of the ball to be thrown. The computer accordingly determines a ball trajectory according to the user's position and parameters indicated by a combination of control-panel settings, user gestures, and user vocal commands. The computer then adjusts the direction, elevation, ball speed, and ball spin to conform to the determined trajectory, and initiates throwing of a ball accordingly.

These devices require substantial distance between the batter and the device, making them unsuitable for foul weather practice. In addition, young children may not yet be ready to practice with devices which propel a ball at the velocities generated by these devices.

U.S. Pat. No. 6,167,878 teaches a ball tossing device for batting practice which includes a pneumatically controlled and actuated mechanism. The device includes a launcher which includes a pneumatic cylinder, a ball carrier and a trough type feeder for sequentially supplying balls to the carrier for throwing. The pneumatic cylinder is actuated by compressed air from a regulated source of highly pressurized air (e.g. air compressor or air tank), with timer means which control actuation of a valve to transmit the compressed air to the cylinder.

U.S. Pat. No. 6,684,872 teaches a fixed point contact practicing machine which includes a vertical ball popping device being disposed on a base of the practicing machine. A pneumatic cylinder utilizes compressed air to compress a coil spring. The compressed air is released from the cylinder to allow the spring to eject the baseball in a vertical manner.

These devices require an air compressor or air tank to provide compressed air. Air compressors are generally very large and expensive pieces of machinery. In addition, air compressors create a great deal of noise and should not be used by young children without adult supervision. Air tanks typically have internal pressures of up to 2000 PSI clearly making them unsuitable for young children to use. Still yet, these devices do not provide a catch net for controlling hit balls and would require a large number of balls which would then have to be retrieved after a short practice period and reloaded into the device.

U.S. Pat. No. 5,746,670 teaches a swing training apparatus which supplies vertically tossed baseballs for a batter to hit. The device includes a catch net and a channel guide to direct collected balls to the spring loaded ball ejector.

While this device provides a catch net to eliminate the need to retrieve balls, the ball ejector is only capable of providing a very predictable vertically tossed ball. This causes the batter to develop timing, and groove his swing to the strike zone for a single type of ball delivery. This does not develop the "eye on the ball" practice needed to hit the ball with the bat as occurs in a game.

While the foregoing described prior art devices have improved the art and in some instances enjoyed commercial success, there remains nonetheless a continuing need in the art for evermore improved, amusing, interesting and entertaining devices to improve a young child's sports enjoyment and ability.

Therefore what is needed in the art is a batting practice device that is capable of delivering balls with suitable trajectory variation to develop "eye on the ball" coordination. The device should include a catch net and a recycling assembly to eliminate the need to chase balls for reloading the device. The device should include a catch net to permit the device to be used indoors for foul weather practice. The device should deliver a lightweight ball to minimize player fatigue to allow increased practice time. The device should also be constructed to break down for compact storage and shipping.

SUMMARY OF THE INVENTION

The objectives are accomplished in accordance with the instant invention by the provision of a training device for batting practice. More specifically, the instant invention provides a catch net in combination with an air powered ball return assembly which recycles a lightweight ball and delivers a soft-toss pitch to the batter.

The device comprises a structural base having a perimeter wall which supports an upper surface. A plurality of inwardly extending sockets are integrally formed into the upper surface for supporting a net frame. A ball catching net is suspended upon the frame for catching a hit ball and deflecting it to the upper surface of the base assembly. The upper surface of the base assembly slopes downward to a centrally located aperture sized to allow the ball to roll and enter the ball return assembly via gravity. The ball return assembly is pivotally suspended below the upper surface and includes a conduit sized to accept the lightweight ball with a small amount of clearance around its circumference. The conduit extends from near the back of the base assembly to the front of the base assembly exiting the front through an upturned ball outlet. Attached to the rear portion of the conduit is a continuous source of moving air which flows through the conduit, increasing the velocity of the ball as it passes through the conduit to the outlet. The ball exits the outlet in the form of a soft-toss pitch having forward motion as well as vertical motion. The cooperation between the ball and the conduit causes suitable variations between the soft-tosses to require the batter to keep his/her eye on the ball for a successful hit. By utilizing the aforementioned soft-toss batting practice device, problems inherent with existing batting practice devices are overcome.

Accordingly, a primary objective of the instant invention is to teach a soft-toss batting practice device.

Another objective of the instant invention is to teach a soft-toss batting practice device which utilizes a lightweight ball for extended practice with reduced batter fatigue.

Yet another objective of the instant invention is to teach a soft-toss batting practice device which delivers soft-tosses with variation to develop eye on the ball coordination.

Still another objective of the instant invention is to teach a batting practice device which is portable.

Still yet another objective of the instant invention is to teach a soft-toss batting practice device that can be broken down for ease of shipment and storage.

Other objectives and advantages of this invention will become apparent from the following description taken in conjunction with the accompanying drawings wherein set forth, by way of illustration and example, certain embodiments of this invention.

The drawings constitute a part of this specification and include exemplary embodiments of the present invention and illustrate various objectives and features thereof.

DETAILED DESCRIPTION OF THE PREFERRED EMBODIMENT

Figure 1:
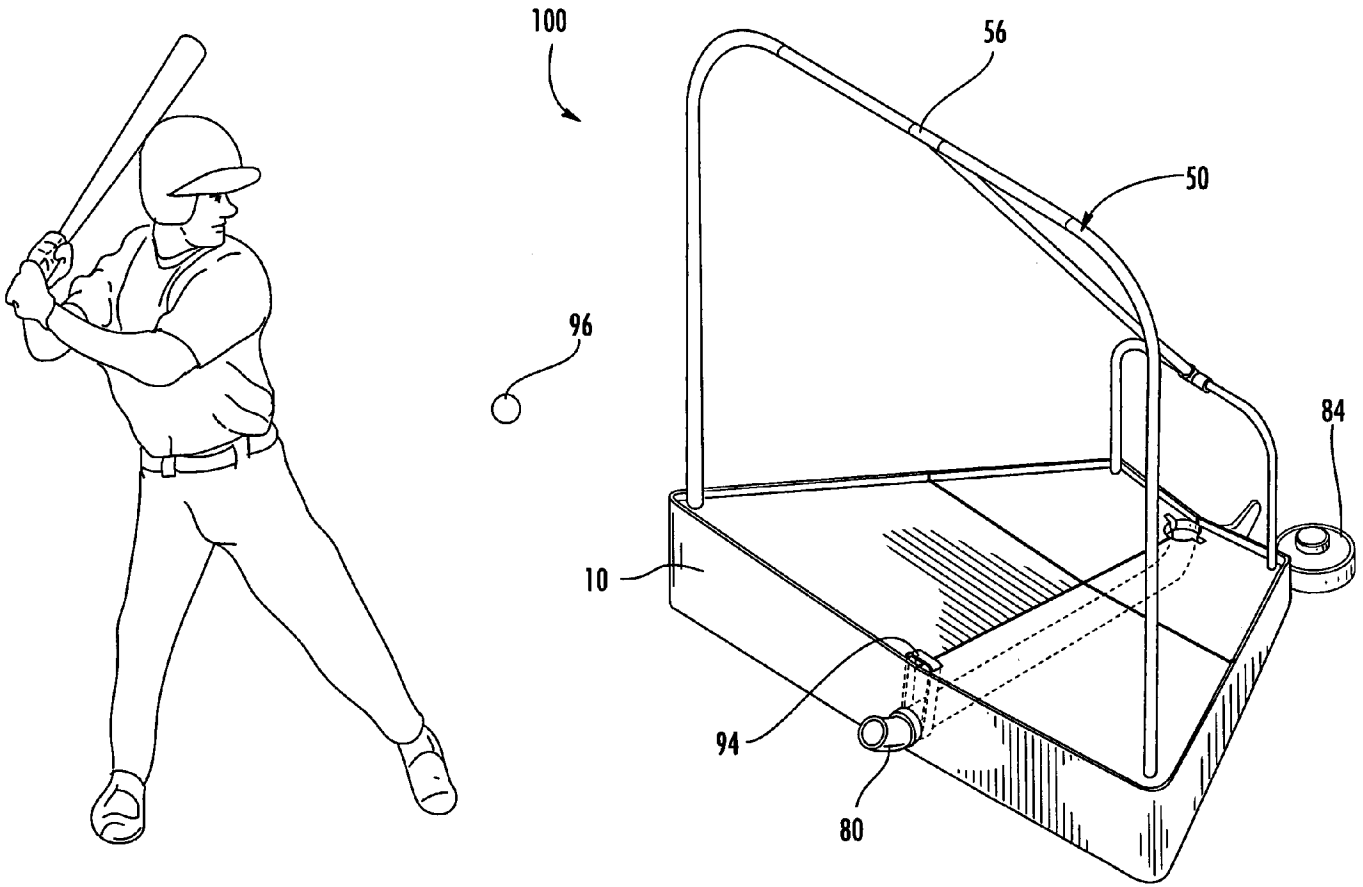
FIG. 1 is a front perspective view of the instant invention illustrated with the net member omitted for clarity.
Figure 2:
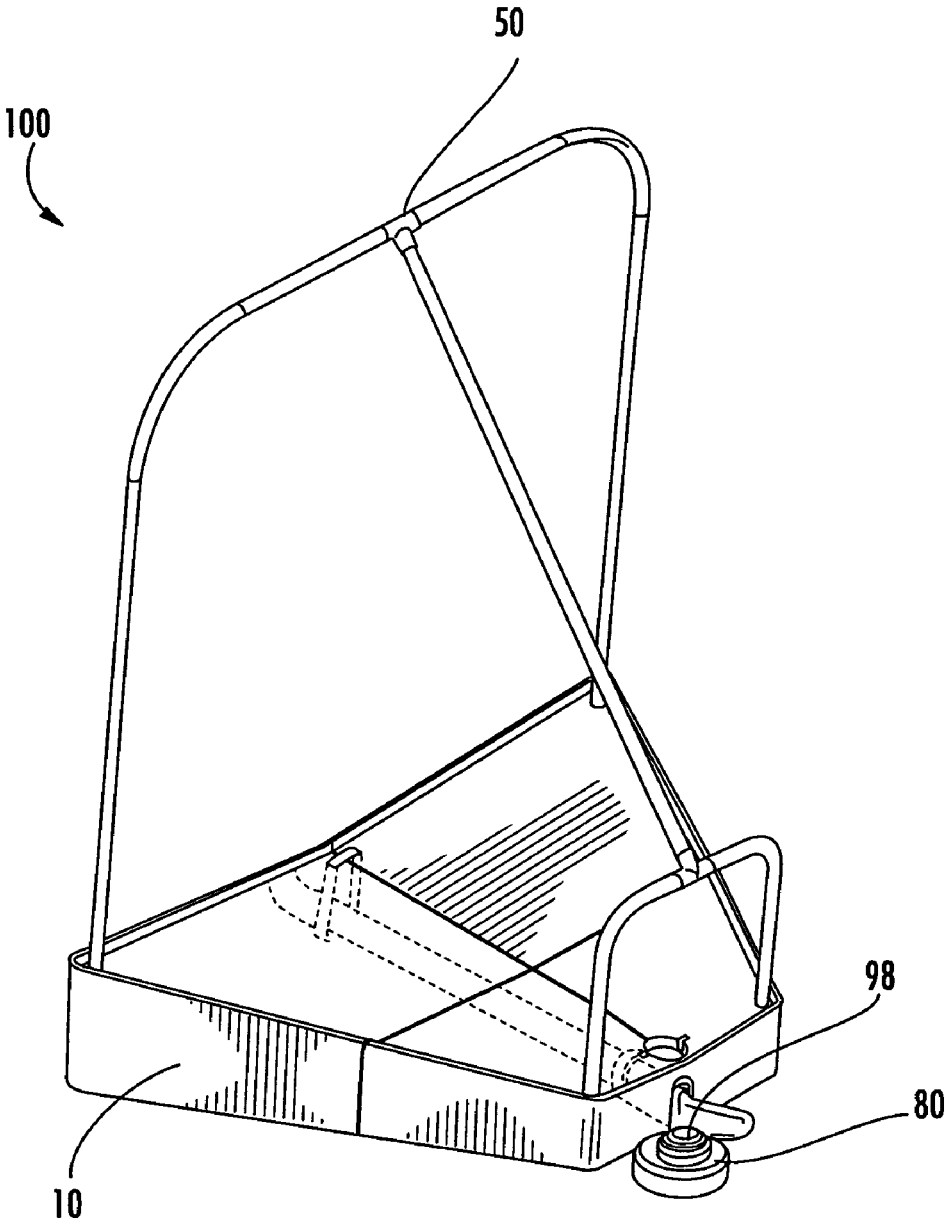
FIG. 2 is a rear perspective view of the instant invention illustrated with the net member omitted for clarity.

Referring now to the embodiment shown in FIGS. 1 and 2. The batting practice device 100 for recycling a lightweight ball is illustrated having the net member omitted for clarity. The batting practice device 100 includes a structural base assembly 10 constructed and arranged to support a net assembly 50 and a ball return assembly 80.

Figure 3:
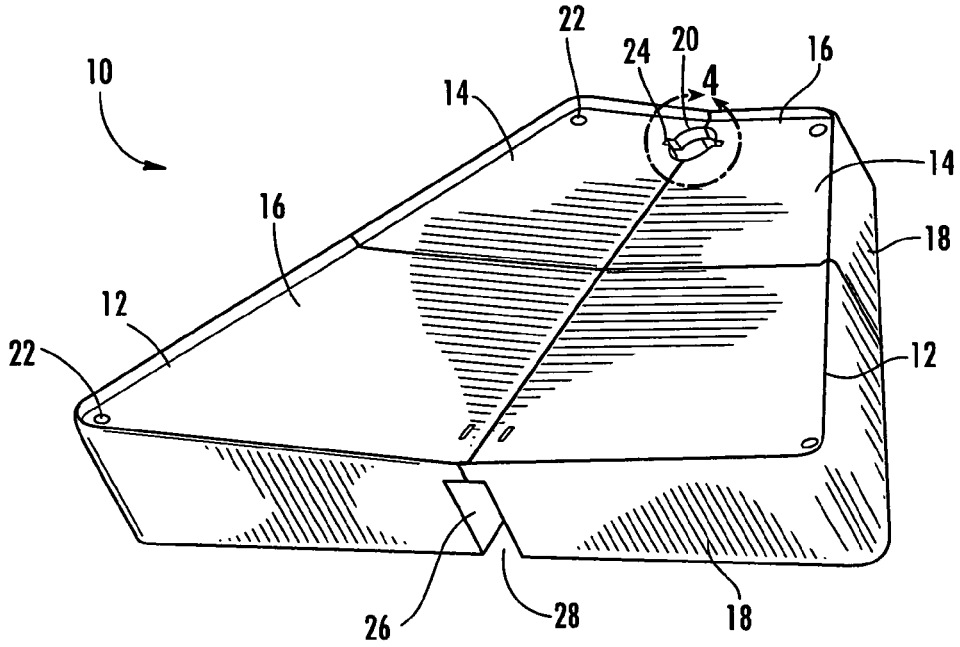
FIG. 3 is a front perspective view illustrating the base assembly of the instant invention.
Figure 4:
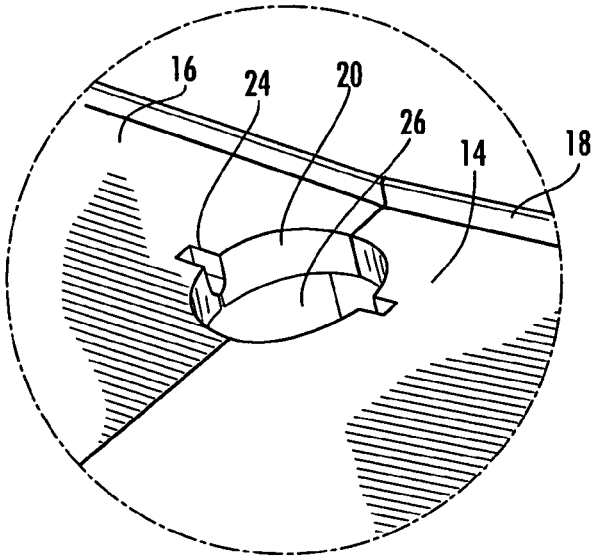
FIG. 4 is a partial view taken along lines 1—1 of FIG. 3 illustrating a ball return aperture and the pin grooves for pivotal attachment of the ball return assembly.
Figure 5:
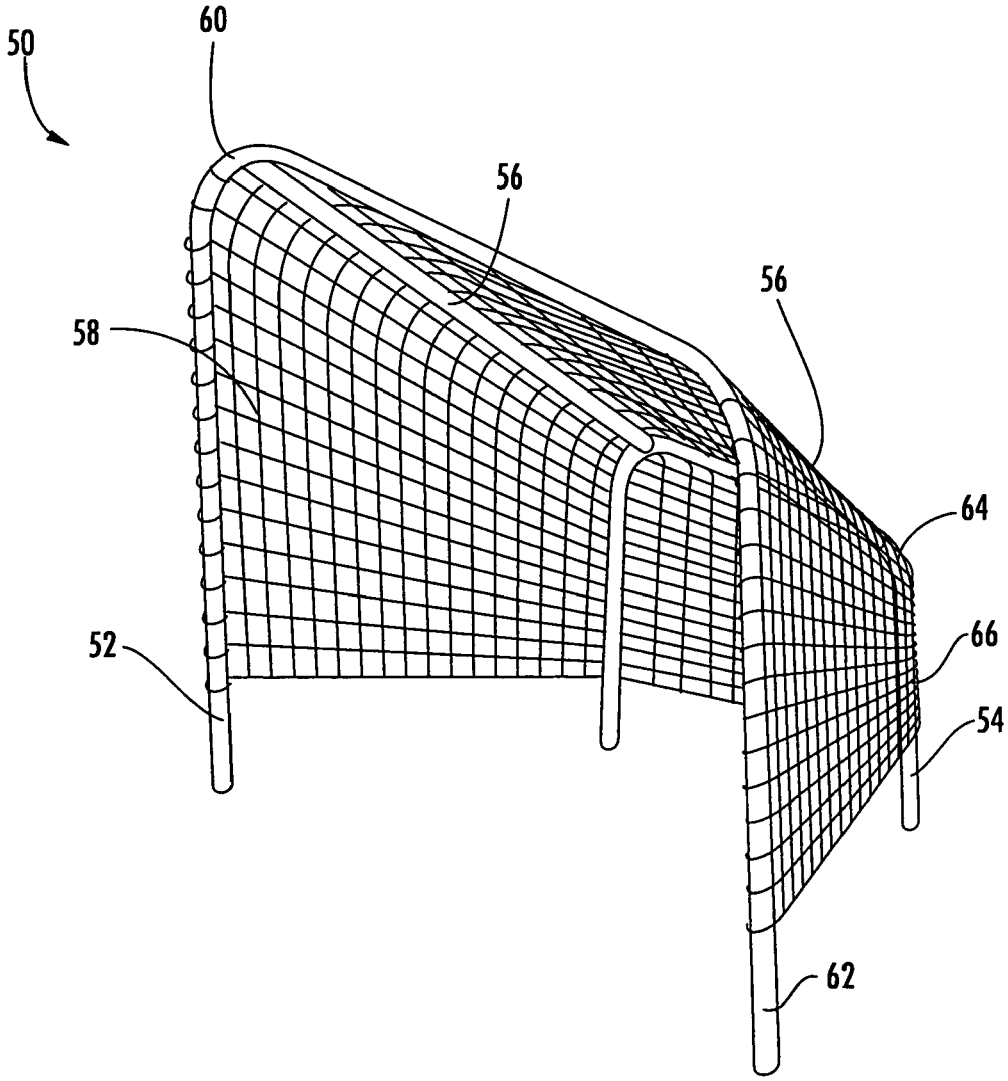
FIG. 5 is a front perspective view of the catch net assembly.

Referring to FIGS. 3 and 4, the base assembly 10 is illustrated. The base assembly 10 is constructed of two front interlocking trapezoidal sections 12 and two back interlocking trapezoidal sections 14 assembled to have a generally trapezoidal overall shape when viewed from the top. The sections are preferably secured together with integrally formed spring tabs or the like (not shown) which are well known in the art. The spring tabs allow the base sections to be easily snapped together to create the base assembly. Each base section 12 and 14 includes an upper surface 16 and a perimeter wall 18. The perimeter wall serves to elevate the upper surface as well as retain hit balls on the upper surface. The innermost perimeter wall 26 of each base section includes an undercut portion 26 constructed and arranged to create a channel 28 which extends through the middle portion of the assembled base assembly 10. The channel is adapted to accept the ball return assembly 80 (FIG. 1). The upper surface 16 slopes downward from the perimeter walls 18 to a drain aperture 20. The drain aperture 20 communicates with the ball return assembly 80 (FIG. 1). Each base section 12 and 14 includes at least one socket 22 for supporting the net assembly 50. Each socket 22 is generally a round integrally formed tubular member which extends downwardly and is structurally supported by gussets and ribs extending between the sockets and the depending perimeter walls 18. The inner diameter of each socket 22 is sized to accept a net assembly frame member 52, 54 (FIG. 5). The drain aperture 20 (FIG. 4) preferably includes two laterally extending pin grooves 24. The pin grooves 24 are integrally formed and adapted to cooperate with the ball return assembly 80. In a preferred non-limiting embodiment the base assembly 10 is constructed from polymeric material by injection molding as is well known in the art. Alternatively, other materials and/or methods well known in the art suitable for manufacturing the base assembly may be utilized.

Referring to FIG. 5, the net assembly 50 is illustrated. The net assembly is generally constructed and arranged to catch a hit ball and direct the hit ball to the upper surface 16 of the base assembly 10. The net assembly includes a front frame member 52, a back frame member 54 and a pair of connector members 56 adapted to support a net member 58 in an open position. The front frame member 52 is generally U-shaped including a radius portion 60 and two generally straight leg portions 62. The leg portions 62 are constructed and arranged to cooperate with respective sockets 22 in each of the front trapezoidal base sections 12. The back frame member 54 is generally U-shaped including a radius portion 64 and two leg portions 66. The leg portions 66 are constructed and arranged to cooperate with a respective one of said sockets 22 in each of said back trapezoidal base sections 14. The connector members 56 attach to the front and back frame members 52, 54 at uppermost and spaced apart positions. In a preferred non-limiting embodiment the frame members and connector members are constructed from plastic tubing, however these members may alternatively be constructed from metal tubing without departing from the scope of the invention.

Figure 6:
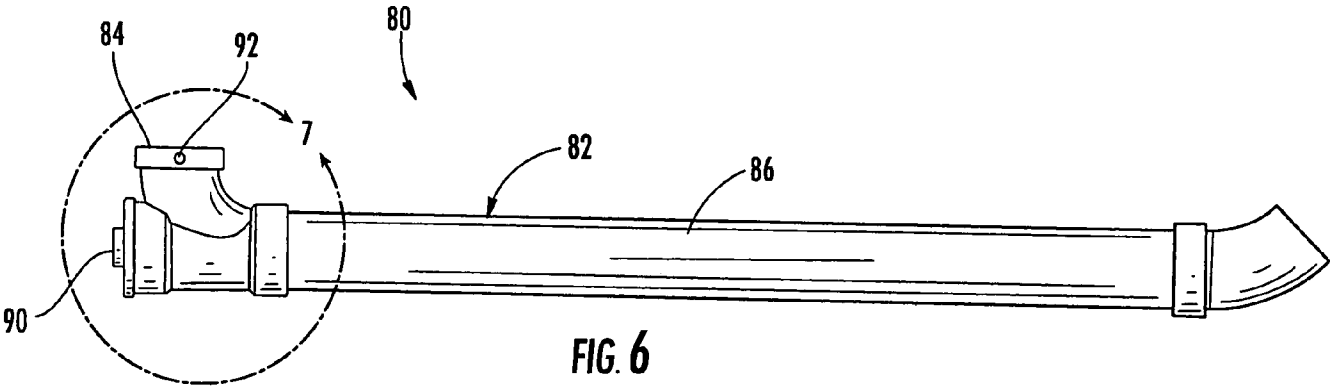
FIG. 6 is a side view of the ball return assembly.
Figure 7:
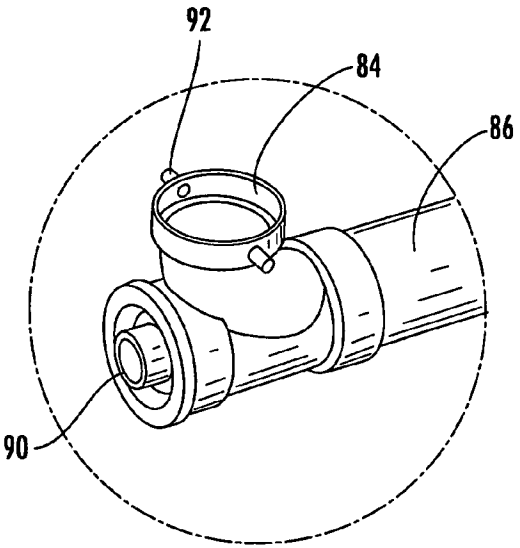
FIG. 7 is a partial perspective view of the ball return assembly illustrating the ball inlet and the air inlet of the instant invention.

Referring to FIGS. 6 and 7 the ball return assembly 80 is illustrated. In general, the ball return assembly is constructed and arranged to receive a lightweight ball from the base assembly 10 via gravity and thereafter soft-toss the lightweight ball to a batter for hitting practice. The ball return assembly 80 includes a ball conduit 82 and blower 84 for producing a continuous source of flowing air. The blower 84 (FIG. 1) in the non-limiting preferred embodiment is a shop-vac. Alternative continuous sources of flowing air may include, but should not be limited to the various types of blower fans driven by motors and/or engines which are well known in the art.

Figure 8:
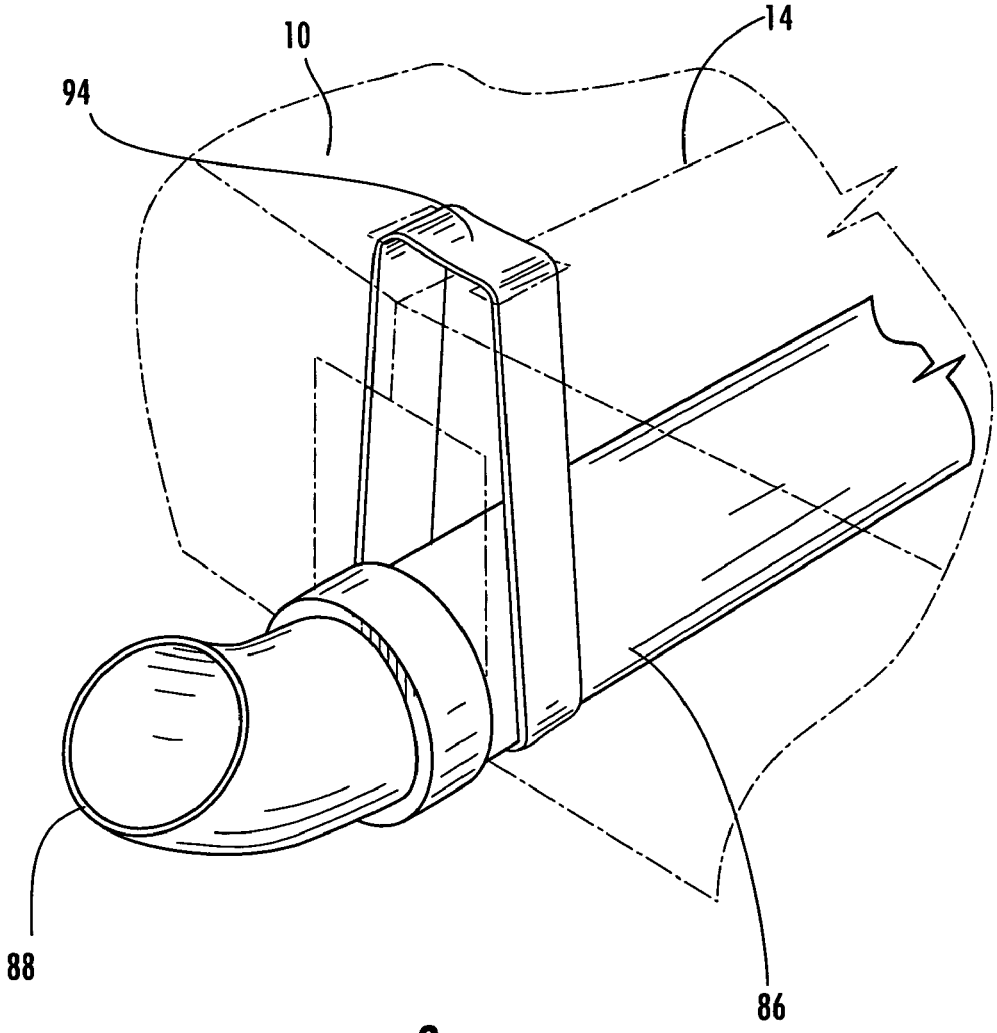
FIG. 8 is a partial perspective view of the base assembly and the ball return assembly illustrating the pitch adjustment strap utilized in the instant invention.

Referring to FIGS. 6–8, the ball conduit 82 includes a ball inlet 84, a center section 86, a ball outlet 88, an air inlet 90 and a blower 84 for producing a continuous stream of air. The ball conduit 82 is preferably constructed from standard plastic plumbing components wherein the ball inlet 84 is a standard 3-inch sewer drain sanitary tee and the ball outlet 88 is a standard 3-inch 45 degree ⅛ bend sewer drain stree. The ball inlet 84 includes two outwardly extending pins 92 constructed and arranged to cooperate with pin grooves 24 (FIGS. 3 and 4) in the base assembly. Adjacent to the ball outlet 88 is a pitch adjustment strap 94 (FIG. 1). The pitch adjustment strap cooperates with the base assembly and the pivotable ball return conduit to allow infinite adjustment of the pitch angle of the soft-tossed ball. In a most preferred embodiment the pitch adjustment strap includes hook and loop fastening for infinite length adjustment. Alternatively snaps or buckles suitable for supporting and adjusting the ball return conduit may be utilized.

In operation, a lightweight polymeric ball (not shown) enters the ball inlet 84 via gravity and a continuous stream of air increases the velocity of ball traveling through the center section 86 and the ball exits from the ball outlet 88 toward a batter in the form of a soft-toss.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

I claim:

1. A batting practice device for selectively recycling a lightweight ball comprising:

a structural base assembly constructed and arranged to support a net assembly, said base assembly including an upper surface, a front, a back, a left and a right depending perimeter wall, wherein said upper surface slopes downward from said perimeter walls to a drain aperture, wherein said drain aperture communicates with a ball return assembly wherein said drain aperture includes two laterally extending pin grooves, wherein said pin grooves are constructed and arranged to cooperate with two laterally protruding pins secured to said ball return assembly for pivotally adjustable support thereof;

a net assembly constructed and arranged to catch a hit ball and direct said hit ball to said base assembly;

a ball return assembly constructed and arranged to receive said ball from said base assembly via gravity and thereafter soft-toss said ball to a batter for hitting practice, wherein said ball return assembly includes a generally round ball conduit, said ball conduit having a ball inlet, a ball outlet and an air inlet;

a source for producing a continuous stream of air in communication with said air inlet;

wherein said ball enters said ball inlet via gravity and said continuous stream of air increases the velocity of said ball traveling through said ball conduit and wherein said ball exits from said ball outlet toward a batter with both horizontal and vertical velocity in the form of a soft-toss, wherein a ball hit into said net assembly is recycled for batting practice.

2. The batting practice device in accordance with claim 1 wherein said base assembly includes a plurality of integrally formed sockets, wherein said sockets are constructed and arranged to support said net assembly.

3. The batting practice device in accordance with claim 1 wherein said base assembly is trapezoidal in shape when viewed from the top.

4. The batting practice device in accordance with claim 3 wherein said base assembly is constructed of two front and two back interlocking trapezoidal sections, wherein each of said sections includes at least one of said sockets for supporting said net assembly.

5. The batting practice device in accordance with claim 1 wherein said net assembly includes a front frame member and a back frame member, wherein said frame members are constructed and arranged to support a net member in an open position, wherein said net assembly is constructed and arranged to direct said ball to said base assembly upper surface.

6. The batting practice device in accordance with claim 5 wherein a front portion of said base assembly includes at least two integrally formed sockets, wherein said sockets are constructed and arranged to support said front frame member, wherein said front frame member is generally U-shaped including a radius portion and two leg portions, wherein said leg portions are constructed and arranged to cooperate with said sockets to support said front frame member in a substantially perpendicular relationship with respect to said base assembly.

7. The batting practice device in accordance with claim 5 wherein a rear portion of said base assembly includes at least two integrally formed sockets, wherein said sockets are constructed and arranged to support said back frame member, wherein said back frame member is generally U-shaped including a radius portion and two leg portions, wherein said leg portions are constructed and arranged to cooperate with said sockets to support said back frame member in a substantially perpendicular relationship with respect to said base assembly.

8. The batting practice device in accordance with claim 5 wherein said front and said back frame members are connected at an uppermost position with a pair of rigid connector members.

9. The batting practice device in accordance with claim 1 wherein said ball conduit includes a center section secured between said ball inlet and said ball outlet, wherein said ball enters said ball inlet via gravity and said continuous stream of air increases the velocity of said ball traveling through said center section and said ball exits from said ball outlet toward said batter in the form of a soft toss.

10. The batting practice device in accordance with claim 1 wherein said ball return assembly includes a blower for creating said continuous stream of air.

11. The batting practice device in accordance with claim 10 wherein said blower is a shop-vac.

12. The batting practice device in accordance with claim 1 wherein said ball conduit is constructed from standard plastic plumbing components.

13. The batting practice device in accordance with claim 9 wherein said ball inlet is a 3 inch sewer drain sanitary tee, wherein said tee includes a ball inlet portion, a connector portion and an air inlet portion, wherein said ball inlet portion includes two laterally protruding pins constructed and arranged to cooperate with at least two drain aperture pin grooves formed into said base assembly for pivotable connection therebetween.

14. The batting practice device in accordance with claim 1 wherein said ball outlet includes a 3 inch 45 degree ⅛ bend sewer drain street elbow.

15. The batting practice device in accordance with claim 1 wherein said base assembly is constructed from polymeric material.

16. The batting practice device in accordance with claim 5 wherein said front frame member and said back frame member are constructed from polymeric material.

17. A batting practice device for selectively recycling a ball comprising:

a structural base assembly constructed and arranged to support a net assembly;

a net assembly constructed and arranged to catch a hit ball and direct said hit ball to said base assembly;

a ball return assembly constructed and arranged to receive said ball from said base assembly via gravity and thereafter soft-toss said ball to a batter for hitting practice, wherein said ball return assembly includes a generally round ball conduit, said ball conduit having a 3 inch sewer drain sanitary tee, wherein said tee includes a ball inlet portion, a connector portion and an air inlet portion, wherein said ball inlet portion includes two laterally protruding pins constructed and arranged to cooperate with at least two drain aperture pin grooves formed into said base assembly for pivotable connection therebetween, a ball outlet and an air inlet, wherein said ball conduit includes a center section secured between said ball inlet and said ball outlet;

a source for producing a continuous stream of air in communication with said air inlet;

wherein said ball enters said ball inlet via gravity and said continuous stream of air increases the velocity of said ball traveling through said ball conduit and wherein said ball exits from said ball outlet toward a batter with both horizontal and vertical velocity in the form of a soft-toss, wherein a ball hit into said net assembly is recycled for batting practice.

18. The batting practice device in accordance with claim 17 wherein said ball return assembly includes a blower for creating said continuous stream of air.

19. The batting practice device in accordance with claim 18 wherein said blower is a shop-vac.

* * * * *